US010468011B2

(12) United States Patent
Ahn

(10) Patent No.: US 10,468,011 B2
(45) Date of Patent: Nov. 5, 2019

(54) METHOD AND DEVICE FOR CLOAKING ACOUSTIC WAVE BY USING SCATTERING MEDIA HAVING SPATIAL PERIODICITY

(71) Applicant: University of Seoul Industry Cooperation Foundation, Seoul (KR)

(72) Inventor: Do Yeol Ahn, Seoul (KR)

(73) Assignee: University of Seoul Industry Cooperation Foundation, Seoul (KR)

( * ) Notice: Subject to any disclaimer, the term of this patent is extended or adjusted under 35 U.S.C. 154(b) by 352 days.

(21) Appl. No.: 15/385,343

(22) Filed: Dec. 20, 2016

(65) Prior Publication Data

US 2017/0103747 A1 Apr. 13, 2017

Related U.S. Application Data

(63) Continuation of application No. PCT/KR2015/009106, filed on Aug. 31, 2015.

(30) Foreign Application Priority Data

Aug. 29, 2014 (KR) ..... 10-2014-0113831

(51) Int. Cl.
*G10K 11/26* (2006.01)
*G10K 11/172* (2006.01)

(52) U.S. Cl.
CPC ..... *G10K 11/26* (2013.01); *G10K 11/172* (2013.01)

(58) Field of Classification Search
CPC ..... G10K 11/26; G10K 15/00; G10K 11/172; G10K 11/162
See application file for complete search history.

(56) References Cited

U.S. PATENT DOCUMENTS 8,172,036 B2 5/2012 Tanielian
8,746,398 B2 * 6/2014 Neogi ..... G10K 11/04 181/155

(Continued)

FOREIGN PATENT DOCUMENTS

JP 2013-545119 A 12/2013
KR 10-2012-0068571 A 6/2012

(Continued)

OTHER PUBLICATIONS

"Implementation of surface acoustic waves using material (p-NG) having negative density", published online Jun. 25, 2013 by Yonsei University, <http://www.ndsl.kr/ndsl/search/detail/report/reportSearchResultDetail.do?cn=TRKO2013000341100>.

(Continued)

*Primary Examiner* — Jeremy A Luks
(74) *Attorney, Agent, or Firm* — Mintz Levin Cohn Ferris Glovsky and Popeo, P.C.; Kongsik Kim; Jhongwoo Jay Peck

(57) ABSTRACT

Disclosed herein are a method and device for cloaking an acoustic wave. A method for cloaking an acoustic wave according to an embodiment of the present invention includes: obtaining a target characteristic of a meta-material based on a correlation between an acoustic propagation mathematical model predetermined for the propagation of an acoustic wave and an electromagnetic wave mathematical model predetermined for an electromagnetic wave; arranging scattering media having a predetermined media density to have spatial periodicity so that the obtained target characteristic is achieved; and blocking a region including a target object from an acoustic wave by disposing the meta-material including the scattering media arranged to have spatial periodicity, to surround the region.

16 Claims, 5 Drawing Sheets

(56) References Cited

U.S. PATENT DOCUMENTS 9,640,170 B2 * 5/2017 Cipolla ..... G10K 11/18
9,677,856 B2 * 6/2017 Pendry ..... F41H 3/00

FOREIGN PATENT DOCUMENTS

KR 10-2013-0047860 A 5/2013
KR 10-2015-0086943 A 7/2015

OTHER PUBLICATIONS

Leonhardt, U., "Optical Conformal Mapping", Science, 312 (2006) 1777.
Pendry, J.B. et al., "Controlling Electromagnetic Fields", Science, 312 (2006) 1780.
Lai, Y. et al., "Complementary media invisibility cloak that cloaks objects at a distance outside the cloaking shell", Phys. Rev. Lettt., 102(9): 093901 (Mar. 6, 2009), 13 pages.
Ahn, Doyeol "Calculation of permittivity tensors for invisibility devices by effective medium approach in general relativity", Jrl. of Modern Optics, vol. 58, Issue 8, 2011 (41 pages).
Urzhumov, Y. et al., Acoustic cloaking transformations from attainable material properties, New Jrl. of Physics, 12 (2010) 22 pages.

* cited by examiner

METHOD AND DEVICE FOR CLOAKING ACOUSTIC WAVE BY USING SCATTERING MEDIA HAVING SPATIAL PERIODICITY

CROSS-REFERENCE TO RELATED APPLICATION

This application is a continuation of PCT/KR2015/009106 filed on Aug. 31, 2015, which claims priority to Korean Application No. 10-2014-0113831 filed on Aug. 29, 2014, which application is incorporated herein by reference.

TECHNICAL FIELD

The present invention relates to a meta-material, and more particularly to a method and device that, by using a meta-material including scattering media arranged to have spatial periodicity, can prevent an acoustic wave in a specific band from propagating to a specific region, or can prevent an acoustic wave generated by a specific object from propagating to the outside.

BACKGROUND ART

Recent research into meta-materials has enabled microscopic control and macroscopic control for an electromagnetic field (see Phys. Rev. Lett. 85, 3966 (2000); Science 312, 1777 (2006); Science 312, 1780 (2006)). A meta-material is a material in which an electromagnetic characteristic that cannot be realized in a general natural state is realized using an artificial method. A meta-material is characterized in that it has a negative refractive index, and thus light is bent in the direction, opposite to a direction in which the light is bent in a normal material, in the meta-material.

A scheme for freely adjusting the direction of an electromagnetic field regardless of the source of the electromagnetic field and also providing guidance while avoiding an object as if there was no object by using such a meta-material was proposed (see Science 312, 1777 (2006); Science 312, 1780 (2006)). This scheme can be potentially applied to radiation shielding from a strong electromagnetic pulse (EMP) or electromagnetic energy having directionality.

Electromagnetic field control using a meta-material is attracting increasing attention in the fields of novel applications, such as an invisibility cloak, a concentrator, and a refractor.

Among these applications, an invisibility cloak is intended to hide an object inside a given geometrical shape, and is the most attractive application. An invisibility cloak is based on the coordinate transformation and conformal mapping of Maxwell's equations, and such invisibility cloaks were independently proposed by Pentry (see Science 312, 1780 (2006)) and Leonhardt (see Science 312, 1777 (2006)).

A full wave electromagnetic simulation of a cylindrical cloak using ideal or non-ideal electromagnetic parameters has been researched, and the experimental implementation of a cylindrical cloak having simple parameters, which operates at a microwave frequency, was announced.

In the analysis and design of an invisibility device, it is most important to calculate permittivity and permeability tensors for a meta-material that constitutes a cloaking shell.

It is assumed that an invisibility device distorts field lines so that the field lines move while avoiding any area having uniform field lines in the corresponding area. This distortion may be considered to be coordinate transformation between an original Cartesian mesh and a distortion mesh.

The theory and experimental implementation of the conventional invisibility device is significantly influenced by the propagation direction of an electromagnetic wave, polarized light, and a wavelength band. Although a technology for improving the efficiency of an invisibility device by using complementary media was proposed in the paper "Complementary media invisibility cloak that cloaks objects at a distance outside the cloaking shell," Y. Lai, H. Chen, Z. Q. Zhang, and C. Chan, Phys. Rev. Lett. 102, 93901 (2009) (published on May 2, 2009), this preceding technology self-proclaims that it is valid only at finite frequencies.

Attempts to overcome this limitation and extend the preceding technology to a theory that is applicable to more general cases were introduced in the paper "Calculation of Permittivity Tensors for Invisibility Devices by Effective Media Approach in General Relativity", Doyeol Ahn, Journal of Modern Optics, Volume 58, Issue 8, 2011 (published on Apr. 4, 2011) and Korean Patent Application Publication No. 10-2013-0047860 (published on May 9, 2013).

In the approaches of the preceding technologies, permittivity and permeability tensors may be scaled using factors obtained via coordinate transformation or optical conformal mapping technology while maintaining the forms of Maxwell's equations that do not change in any coordinate system.

Furthermore, a method for calculating permittivity and permeability tensors for an invisibility device by using electrodynamics in the frame of the theory of relativity was researched.

The principle idea of this preceding technology is based on the fact that in curved space-time, the propagation of an electromagnetic wave appears as wave travelling in an inhomogeneous effective bi-anisotropic media. The constitutive parameters thereof are determined by a space-time metric.

This technology can express the inverse problem of transformation into any curved space-time in a media inside flat space-time, and can find specific conditions for invisibility cloaking.

The above-described preceding technologies relate to invisibility techniques in which a cloaking target is limited to an electromagnetic wave. There is no embodied preceding technology in which a cloaking target is an acoustic wave.

SUMMARY OF THE DISCLOSURE

Accordingly, the present invention has been made to overcome the problems of the preceding technologies, and an object of the present invention is to provide a method and device for cloaking an acoustic wave, which, by using a meta-material including scattering media arranged to have spatial periodicity, for example, scattering media arranged in a structure corresponding to a photonic crystal structure, can block a specific region from an acoustic wave in a specific band, can exclude a specific region from the path of an acoustic wave in a specific band, or can prevent an acoustic wave generated by a specific object from propagating to the outside.

An object of the present invention is to provide a method and device for cloaking an acoustic wave, which can block or cloak an acoustic wave in a specific band when an acoustic wave cloaking target region has any geometrical shape.

An object of the present invention is to provide a method and device that can block a specific region from an acoustic wave in a specific band regardless of factors of the acoustic wave, such as the frequency or velocity of the acoustic wave.

According to an aspect of the present invention, there is provided a method of cloaking an acoustic wave, the method including: obtaining a target characteristic of a meta-material based on a correlation between an acoustic propagation mathematical model predetermined for the propagation of an acoustic wave and an electromagnetic wave mathematical model predetermined for an electromagnetic wave; arranging scattering media, having a predetermined media density, to have spatial periodicity so that the obtained target characteristic is achieved; and blocking a region, including a target object, from an acoustic wave by disposing the meta-material, including the scattering media arranged to have spatial periodicity, to surround the region.

The obtaining may include obtaining a correspondence between the acoustic propagation parameters of the acoustic propagation mathematical model and the electromagnetic wave parameters of the electromagnetic wave mathematical model, and obtaining the target characteristic of the meta-material by using the obtained correspondence between the acoustic propagation parameters and the electromagnetic wave parameters.

The arranging may include arranging, based on a correlation between media density among the acoustic propagation parameters of the acoustic propagation mathematical model and permittivity among the electromagnetic wave parameters of the electromagnetic wave mathematical model, the scattering media to have spatial periodicity so that a structure corresponding to a photonic crystal structure is achieved.

The arranging may include arranging the scattering media in a local resonance structure that induces local resonance.

The obtaining may include transforming the acoustic propagation mathematical model into an acoustic wave cloaking mathematical model, corresponding to the electromagnetic wave mathematical model and including a time variable for time dependency, based on a correlation between the acoustic propagation mathematical model and the electromagnetic wave mathematical model, and obtaining the target characteristic of the meta-material by using the obtained the acoustic wave cloaking mathematical model.

The arranging may include arranging the scattering media having an identical media density to have at least two different types of spatial periodicity.

The arranging may include arranging at least two different types of scattering media having different media densities to have identical spatial periodicity or different types of spatial periodicity.

The blocking may include blocking the region from the acoustic wave by stacking a first meta-material, including first scattering media arranged to have first spatial periodicity, and a second meta-material, including second scattering media arranged to have second spatial periodicity, to surround the region.

According to another aspect of the present invention, there is provided a device for cloaking an acoustic wave by using a meta-material, wherein the meta-material: has a target characteristic obtained based on a correlation between an acoustic propagation mathematical model predetermined for the propagation of an acoustic wave and an electromagnetic wave mathematical model predetermined for an electromagnetic wave; comprises scattering media having a predetermined media density and arranged to have spatial periodicity so that the obtained target characteristic is achieved; and is disposed to surround a region including a target object to be blocked from an acoustic wave.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE DISCLOSURE

Figure 1:
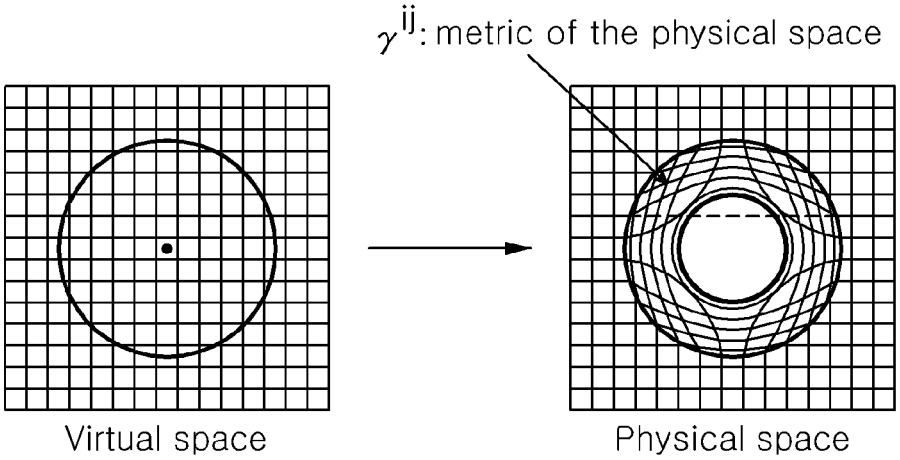
FIG. 1 shows an example of an invisibility cloak based on a space-time meta-material analysis method using the theory of general relativity.

Embodiments of the present invention will be described in detail with reference to the accompanying drawings. In the following description of the present invention, a detailed description of a related well-known component or function will be omitted when it is determined that the detailed description may make the gist of the present invention obscure.

The prevent invention is not limited to the embodiments. Throughout the accompanying drawings, the same reference symbols designate the same components.

A method and device for cloaking an acoustic wave according to embodiments of the present invention will be described in detail below with reference to FIGS. 1 to 5.

The term "meta-material" used herein is defined as follows. That is, the term "meta-material" is used to refer to a material the permittivity, permeability, density and modulus tensors of which can be artificially controlled or designed, or is used to refer to a material which is obtained as a result of the control or design.

An invisibility device is based on a theoretical basis in which when Maxwell's equations are established in space-time having finite curvature, the curvature of the space-time acts like permittivity and permeability with respect to electric and magnetic fields.

More specifically, in the theory of general relativity, covariant Maxwell's equations may be expressed by Equation 1 below:

$$F^{\mu\nu};\mu = \frac{\varepsilon_0}{\sqrt{-g}}\frac{\partial}{\partial x^\mu}\left(\sqrt{-g}\,F^{\mu\nu}\right) = -J^\nu \tag{1}$$

$$F_{\mu\nu;\lambda} + F_{\lambda\mu;\nu} + F_{\nu\lambda;\mu} = 0$$

where the subscript ";" is a covariant derivative, $\varepsilon_0$ is permittivity in free space, and $\mu$, $\nu$ and $\lambda$ are respective components of 4D coordinate space in an arbitrary 4D coordinate system.

Furthermore, g is the determinant of metric tensor $g_{\mu\nu}$, J is current density, and $F_{\mu\nu}$ is an electromagnetic field tensor.

The process of deriving Equation 1 is disclosed in Korean Patent Application Publication No. 10-2013-0047860 (published on May 9, 2013) and the paper "Calculation of permittivity tensors for invisibility devices by effective media approach in general relativity", Doyeol Ahn, Journal of Modern Optics, Volume 58, Issue 8, 2011 (published on Apr. 1, 2011). Furthermore, processes of deriving the following plurality of equations are disclosed in the above-described preceding technology documents. Accordingly, in the present specification, brief descriptions will be given with a focus on principal items, adopted in the present invention, within the range in which the gist of the present invention is not made obscure.

In this case, the electromagnetic field tensor may be expressed by Equation 2 below. The electromagnetic field tensor is described in the form of a matrix of a zero dimension (time) and the three dimensions of space in the theory of general relativity.

$$F_{\mu\nu} = \begin{pmatrix} 0 & -E_x & -E_y & -E_z \\ E_x & 0 & B_z & -B_y \\ E_y & -B_z & 0 & B_x \\ E_z & B_y & -B_x & 0 \end{pmatrix} \tag{2}$$

where E is an electric field, x, y and z are directions, and B is electric flux.

Furthermore, contra-variant tensor $H^{\mu\nu}$ may be expressed by Equation 3 below, and Equation 3 may be defined by Equation 4 below:

$$H^{\mu\nu} = \varepsilon_0 \frac{\sqrt{-g}}{2}(g^{\mu\lambda}g^{\nu\rho} - g^{\mu\rho}g^{\nu\lambda})F_{\lambda\rho} \tag{3}$$

$$H^{\mu\nu} = \begin{pmatrix} 0 & D_x & D_y & D_z \\ -D_x & 0 & H_z & -H_y \\ -D_y & -H_z & 0 & H_x \\ -D_z & H_y & -H_x & 0 \end{pmatrix} \tag{4}$$

where H is a magnetic field, and D is magnetic flux.

When the above-described equations are rearranged, the relations of Equations 5 and 6 are obtained below:

$$D_i = (-g)^{1/2}\varepsilon_0(g^{0j}g^{i0} - g^{00}g^{ij})E_j + (-g)^{1/2}[jkl]g^{0k}g^{jl}\mu_0^{-1}B_j \tag{5}$$

$$H_i = \frac{1}{\sqrt{-g}}[jkl]g_{0k}g_{il}\varepsilon_0 E_j - \frac{1}{\sqrt{-g}}(g_{i0}g_{j0} - g_{00}g_{ij})\mu_0^{-1}B_j \tag{6}$$

where [ijk] is an anti-symmetric permutation symbol and is defined as [xyz]=1, $\mu_0$ is permeability in free space, $g^{ab}$ is the (a, b) component of a contra-variant metric tensor, and $g_{cd}$ is the (c, d) component of a covariant metric tensor.

From the above-described equations, it can be seen that Maxwell's equations in a vacuum having a finite radius of curvature may be interpreted as Maxwell's equations in a media having finite permittivity and permeability.

FIG. 1 shows an example of an invisibility cloak based on a space-time meta-material analysis method using the theory of general relativity. An empty space at the center of physical space refers to a space that is used to hide a given object.

Furthermore, virtual space refers to space that is obtained by transforming the empty space of the physical space into a center point. Based on this relationship, an intuitive picture of the invisibility cloak may be generated using the physical space and the virtual space, in which actual invisibility cloaking is implemented, and coordinate transformation between these two spaces. The coordinate transformation between these two spaces may be described using metric tensor $g_{\mu\nu}$ in space-time. When a metric tensor indicative of curvilinear coordinates in physical space is defined as $\gamma'_{ij}$, a transformation equation between the two spaces is given as Equation 7 below, the permittivity tensor $\varepsilon^{ij}$ and permeability tensor $\mu^{ij}$ of the physical space that are implemented using a meta-material may be expressed by Equation 8 below:

$$g^{ij} = \frac{\partial x^i}{\partial x'^k}\frac{\partial x^j}{\partial x'^l}\gamma'^{kl} \tag{7}$$

$$\varepsilon^{ij} = \pm\frac{(\det(-g))^{1/2}}{\sqrt{\det(\gamma)}}(g^{0j}g^{i0} - g^{00}g^{ij}), \tag{8}$$

$$(\mu^{-1})_{ij} = \pm\frac{\sqrt{\det(\gamma)}}{\sqrt{\det(-g)}}(g_{i0}g_{j0} - g_{00}g_{ij})$$

where $\gamma$ is $\gamma_{ij}$, and $\gamma^{kk}=1/\gamma_{kk}$.

However, the invisibility cloak implemented using the above-described method has a disadvantage in that when an electromagnetic wave is polarized in a specific direction, the efficiency of invisibility is maximized.

The gist of the present invention lies in that an acoustic wave cloaking mathematical model adapted to block an acoustic wave in a specific band or to make an acoustic wave in a specific band invisible is derived from a mathematical model for the propagation of an acoustic wave by using the content of the papers by J. Mod. Opt. 58, 700-710 (2011), Journal of the Korean Physical Society 60, 1349-1360 (2012), JOSA B 30, 140-148 (2013), which is disclosed by the inventor of the present invention, and also using the Maxwell's equations-based relativistic coordinate-space transformation method used for a invisibility cloak for an electromagnetic wave in the paper of the inventor of the present invention, and the target characteristic of a meta-material adapted to block the acoustic wave in the specific band is obtained by using the derived acoustic wave cloaking mathematical model, thereby making a specific region invisible from the acoustic wave in the specific band or preventing the acoustic wave from propagating to a specific area.

In the present invention, an electromagnetic wave mathematical model including Maxwell's equations and an acoustic propagation mathematical model for the propagation of an acoustic wave are mathematical models having generalized time dependency, and thus the acoustic wave cloaking mathematical model according to the present invention is also a mathematical model having generalized time dependency. Accordingly, the present invention may be applied to an acoustic wave cloaking target region having any geometrical shape that is applied to one or more of all coordinate systems including an elliptic coordinate system, a bipolar coordinate system, a Cartesian coordinate system, a cylindrical coordinate system, a spherical coordinate system, etc.

Figure 2:
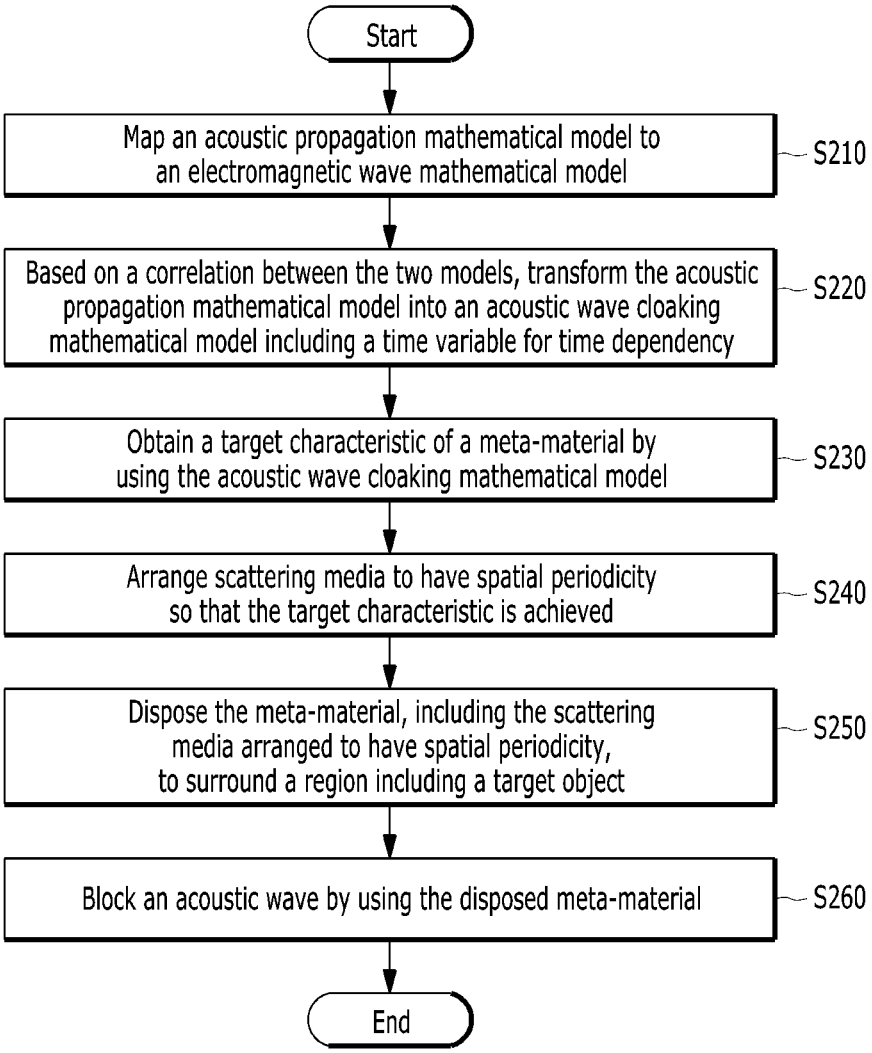
FIG. 2 is an operation flowchart showing a method of cloaking an acoustic wave according to an embodiment of the present invention.

FIG. 2 is an operation flowchart showing a method of cloaking an acoustic wave according to an embodiment of the present invention.

Referring to FIG. 2, the method of cloaking an acoustic wave according to the present embodiment includes step S210 of mapping an acoustic propagation mathematical model for the propagation of an acoustic wave to an electromagnetic wave mathematical model for an electromagnetic wave, and step S220 of transforming the acoustic propagation mathematical model into an acoustic wave cloaking mathematical model corresponding to the electromagnetic wave mathematical model based on a correlation between the acoustic propagation mathematical model and the electromagnetic wave mathematical model.

In this case, the acoustic propagation mathematical model and the electromagnetic wave mathematical model are generalized mathematical models having time dependency, and the acoustic wave cloaking mathematical model may also be a generalized mathematical model having time dependency.

In this case, the electromagnetic wave mathematical model may be a Maxwell's equations-based mathematical model, and the acoustic wave cloaking mathematical model may be transformed from the acoustic propagation mathematical model by applying the acoustic propagation mathematical model into a Maxwell's equations-based relativistic coordinate-space transformation method.

An acoustic wave equation for the acoustic propagation mathematical model may be expressed by Equation 9 below:

$$\rho\frac{\partial\vec{v}}{\partial t} = -\vec{\nabla}_p, \qquad \frac{\partial p}{\partial t} = -\lambda\vec{\nabla}\cdot\vec{v} \tag{9}$$

where p is pressure, $\vec{v}$ is the velocity vector of a fluid, ρ is the mass of the fluid or a media, and λ is the bulk modulus of the fluid or media.

The acoustic wave equation has a one-to-one correspondence with Maxwell's equations, i.e., the electromagnetic wave mathematical model, for specific polarization, in the case of 2D. A method for an invisibility cloak related to an electromagnetic wave may be utilized based on the above correlation.

The acoustic wave equation may be expressed for generalized curvilinear coordinates $q_1$, $q_2$, and $q_3$ by Equation 10 below:

$$\vec{\nabla}_p = \hat{q}_1\frac{1}{h_1}\frac{\partial p}{\partial q_1} + \hat{q}_2\frac{1}{h_2}\frac{\partial p}{\partial q_2} + \hat{q}_3\frac{1}{h_3}\frac{\partial p}{\partial q_3} \tag{10}$$

$$\vec{\nabla}\cdot\vec{v} = \frac{1}{h_1h_2h_3}\left[\frac{\partial}{\partial q_1}(v_1h_2h_3) + \frac{\partial}{\partial q_2}(v_2h_3h_1) + \frac{\partial}{\partial q_3}(v_3h_1h_2)\right]$$

where $\hat{q}_1$ is a unit vector (i=1, 2, 3) in a $q_1$ axis direction, and $h_1$ is a metric indicative of the distance between two points along a $q_1$ axis.

For convenience's sake, assuming that symmetry is present with respect to a z axis in 2D, the case where $q_3$=z, $h_3$=1, and $$\frac{\partial}{\partial z} = 0$$

may be contemplated. In particular, when generalized time dependency is present, the acoustic wave equation may be expressed by Equation 11 below:

$$\rho_1\frac{\partial v_i}{\partial t} = -\frac{1}{h_1}\frac{\partial p}{\partial q_i}, \qquad \rho_1\frac{\partial v_2}{\partial t} = -\frac{1}{h_2}\frac{\partial p}{\partial q_2}, \qquad \frac{1}{\lambda}\frac{\partial p}{\partial t} = -\frac{1}{h_1h_2}\left[\frac{\partial}{\partial q_1}(v_1h_2) + \frac{\partial}{\partial q_2}(v_2h_1)\right] \tag{11}$$

Furthermore, Maxwell's equations for an electromagnetic field may be expressed by Equation 12 below, and Maxwell's equations for a general vector field $\vec{F}$ may be expressed by Equation 13 below:

$$\vec{\nabla}\times\vec{E} = -\frac{\partial\vec{B}}{\partial t},\ \vec{\nabla}\times\vec{H} = -\frac{\partial\vec{D}}{\partial t},\ \nabla\cdot\vec{D} = 0,\ \vec{\nabla}\cdot\vec{B} = 0 \tag{12}$$

$$\begin{aligned}\vec{\nabla}\times\vec{F} = {} & \vec{q}_1\frac{1}{h_2h_3}\left\{\frac{\partial}{\partial q_2}(h_3F_3) - \frac{\partial}{\partial q_3}(h_2F_2)\right\} + \\ & \vec{q}_2\frac{1}{h_3h_1}\left\{\frac{\partial}{\partial q_3}(h_1F_1) - \frac{\partial}{\partial q_1}(h_3F_3)\right\} + \\ & \vec{q}_3\frac{1}{h_1h_2}\left\{\frac{\partial}{\partial q_1}(h_2F_2) - \frac{\partial}{\partial q_3}(h_1F_1)\right\}\end{aligned} \tag{13}$$

When Maxwell's equations are unchangeable with respect to the Z axis, they may be expressed by Equations 14 and 15 below:

$$\begin{aligned}\vec{\nabla}\times\vec{H} &= \hat{q}_1\frac{1}{h_2}\frac{\partial}{\partial q_2}H_z - \hat{q}_2\frac{1}{h_1}\frac{\partial}{\partial q_1}H_z + \\ &\quad \hat{z}\frac{1}{h_1h_2}\left\{\frac{\partial}{\partial q_1}(h_2H_2) - \frac{\partial}{\partial q_2}(h_1H_1)\right\} \\ &= \frac{\partial}{\partial t}\vec{D} \\ &= \hat{q}_1\varepsilon_1\frac{\partial}{\partial t}E_1 + \hat{q}_2\varepsilon_2\frac{\partial}{\partial t}E_2 + \hat{q}_3\varepsilon_3\frac{\partial}{\partial t}E_3\end{aligned} \tag{14}$$

$$\begin{aligned}\vec{\nabla}\times\vec{E} &= \hat{q}_1\frac{1}{h_2}\frac{\partial}{\partial q_2}E_z - \hat{q}_2\frac{1}{h_1}\frac{\partial}{\partial q_1}E_z + \\ &\quad \hat{z}\frac{1}{h_1h_2}\left\{\frac{\partial}{\partial q_1}(h_2E_2) - \frac{\partial}{\partial q_2}(h_1E_1)\right\} \\ &= -\frac{\partial}{\partial t}\vec{B} \\ &= -\hat{q}_1\mu_1\frac{\partial}{\partial t}H_1 - \hat{q}_2\mu_2\frac{\partial}{\partial t}H_2 - \hat{q}_3\mu_3\frac{\partial}{\partial t}H_3\end{aligned} \tag{15}$$

When generalized time dependency is present for transverse magnetic (TM) waves E1, E2 and Hz, Equation 16 below is obtained from Equations 14 and 15:

$$\varepsilon_1\frac{\partial}{\partial t}E_1 = \frac{1}{h_2}\frac{\partial}{\partial q_2}H_z, \qquad \varepsilon_2\frac{\partial}{\partial t}E_2 = -\frac{1}{h_1}\frac{\partial}{\partial q_1}H_z, \qquad -\mu_z\frac{\partial}{\partial t}H_z = \frac{1}{h_1h_2}\left\{\frac{\partial}{\partial q_1}h_2E_2 - \frac{\partial}{\partial q_2}h_1E_1\right\} \tag{16}$$

When Equation 11 is compared with Equation 16, it can be seen that when variables (acoustic propagation parameters) for the acoustic wave equation and variables (electromagnetic wave parameters) for the electromagnetic wave equation have a one-to-one correspondence, as represented by Equation 17 below, they have equivalent equation forms:

$$[p,\nu_1,\nu_2,\rho_1,\rho_2,\lambda^{-1}] \leftrightarrow [H_z,E_2,-E_1,\varepsilon_2,\varepsilon_2,\mu_z] \quad (17)$$

The mathematical model of an acoustic wave may be converted into an acoustic wave cloaking mathematical model including a time variable and corresponding to generalized time dependency corresponding to the electromagnetic wave mathematical model by using the relation of Equation 17.

As described above, the present invention is configured to utilize the content of the papers by J. Mod. Opt. 58, 700-710 (2011), Journal of the Korean Physical Society 60, 1349-1360 (2012), JOSA B 30, 140-148 (2013), JOSA B 30, 2148 (2013), which is disclosed by the inventor of the present invention, and to apply the acoustic propagation mathematical model into the Maxwell's equations-based relativistic coordinate-space transformation method, thereby blocking an acoustic wave.

Referring back to FIG. 2, a target characteristic of the meta-material is obtained using the acoustic wave cloaking mathematical model transformed from the acoustic propagation mathematical model by applying the acoustic propagation mathematical model into the Maxwell's equations-based relativistic coordinate-space transformation method at step S230.

In this case, the target characteristic of the meta-material may include the density of a fluid, the mass of media, the bulk modulus of the fluid or media, the density of the media, or the like.

In this case, at step S230, a correspondence between the acoustic propagation parameters of the acoustic propagation mathematical model and the electromagnetic wave parameters of the electromagnetic wave mathematical model may be obtained, and the target characteristic of the meta-material may be obtained using the obtained correspondence between the acoustic propagation parameters and the electromagnetic wave parameters.

To have the target characteristic obtained at step S230, scattering media having a specific media density are arranged to have spatial periodicity at step S240, a meta-material including the scattering media arranged to have spatial periodicity is disposed to surround a region including a target object at step S250, and thus an acoustic wave in a specific band is blocked using the meta-material at step S260, thereby blocking the acoustic wave in the specific band propagating to the region including the target object or preventing the acoustic wave in the specific band, generated by the region including the target object, from propagating to the outside.

In this case, at step S240, the scattering media may be arranged to have spatial periodicity so that a structure corresponding to a photonic crystal structure is achieved based on a correspondence between media density among the acoustic propagation parameters acoustic propagation mathematical model and permittivity among the electromagnetic wave parameters of the electromagnetic wave mathematical model.

In this case, at step S240, the scattering media may be arranged to have spatial periodicity by arranging the scattering media in a local resonance structure that induces local resonance.

Furthermore, at step S240, scattering media having the same media density may be arranged to have two or more different types of spatial periodicity. Alternatively, two or more types of scattering media having different densities may be arranged to have the same type of spatial periodicity or different types of spatial periodicity, thereby enabling the meta-material including the scattering media to have the target characteristic obtained at step S230.

Furthermore, at step S260, although the region including the target object may be blocked from the acoustic wave in the specific band by using the meta-material including scattering media having a single type of spatial periodicity, the present invention is not limited thereto. A meta-material including scattering media having two or more different types of spatial periodicity and the same media density may be used. Alternatively, a meta-material in which different types of scattering media having different media densities are arranged to have the same spatial periodicity or different types of spatial periodicity may be used. Alternatively, a first meta-material including a first type of scattering media arranged to have a first type of spatial periodicity and a second meta-material including a second type of scattering media arranged to have a second type of spatial periodicity may be arranged in an overlapping manner according to a predetermined rule, thereby blocking the region including the target object from an acoustic wave in a specific band.

It will be apparent that when a plurality of meta-materials are arranged in an overlapping manner and thus block an acoustic wave in a specific band, each of the meta-materials may include scattering media having two or more different types of spatial periodicity and the same media density, or may include two or more different types of scattering media having different media densities and the same spatial periodicity or different types of spatial periodicity.

The term "target object" used herein may be based on a spatial concept, or may be an object corresponding to a noise source.

The process of enabling the meta-material to have the target characteristic by arranging the scattering media, having a media density, to have spatial periodicity at step S240 will be described in greater detail below.

In the case of an electromagnetic wave, when permittivity $\varepsilon$ is arranged according to a periodic function, as represented by Equation 18 below, a photonic crystal structure is formed, and thus it is possible to control the radio wave of a specific electromagnetic wave or block an electromagnetic wave in a specific frequency band. Since this fact is obvious to those skilled in the art, a detailed description thereof is omitted.

$$\varepsilon(\vec{r}+\vec{R})=\varepsilon(\vec{r}) \quad (18)$$

where $\vec{R}$ is the period of the permittivity.

Based on the above-described Equation 17, an acoustic wave has a one-to-one correspondence with an electromagnetic wave. Accordingly, when the density of the media is made to have location dependence, as represented by Equation 19 below, a physical characteristic similar to that of a photonic crystal structure is obtained:

$$\sigma(\vec{r}+\vec{R})=\sigma(\vec{r}) \quad (19)$$

In this case, Equation 19 assumes isotropy in which $\sigma_1=\sigma_2$ in Equation 17.

When the acoustic wave propagation velocity of media is $\nu_s$ and the period in which the density of the media changes is $\alpha$, a characteristic frequency in a crystal structure for an acoustic wave becomes $\nu_s/\alpha$, and thus an disadvantage arises in that the period of an acoustic wave corresponding to the audible frequency band increases. Liu, et el. released experimental results in which when media resonating locally was used as a lattice, the period in which density changed could be decreased 100 times (see J. Liu et al., Science 289, 1734 2000).

As described above, according to the present invention, the scattering media having media density are arranged in a structure having spatial periodicity, as shown in Equation 19, for example, a lattice structure, by using Equations 17 and 18, thereby blocking an acoustic wave in a specific band.

The scattering media included in the meta-material according to the present invention may include metal spheres, metal pipes, etc. In this case, the metal may include all metals, including iron, copper, aluminum, etc. Depending on the situation, objects obtained by coating metal spheres, metal pipes, or the like with a specific material, for example, silicone rubber, and thus configured to include both the metal and the silicone rubber may be referred to as "scattering media."

It will be apparent that the coating material is not limited to silicone rubber but any material similar to silicone rubber may be used.

The radius of metal used in the scattering media may range from 1 mm to 50 cm, and the thickness of the coating layer, such as silicone rubber, may range from 1 mm to 5 cm.

As described above, the method according to the present invention can block a specific region from an acoustic wave in a specific band or can prevent an acoustic wave in a specific band generated by a specific object from propagating to the outside by using the meta-material including the scattering media arranged to have spatial periodicity, and is applicable to all coordinate systems including generalized time dependency by obtaining the target characteristic of the meta-material by using a mathematical model including generalized time dependency.

Furthermore, the present invention can block an acoustic wave in a specific band by arranging scattering media in an arrangement having spatial periodicity, for example, a local resonance structure corresponding to a photonic crystal structure. For example, using the meta-material having a target characteristic according to the present invention, a noise source in a specific band may be isolated, an acoustic wave in a specific band can be fundamentally blocked in a desired area, and the present invention can be applied to the mitigation of noise between floors in an apartment building and a reduction of the noise level of a ship, a submarine or a vehicle in principle.

Furthermore, the present invention can block a specific region from an acoustic wave in a specific band regardless of factors, such as the frequency or velocity of the acoustic wave, by using the target characteristic of the meta-material.

As described above, although the method according to the present invention has been described as obtaining the target characteristic of the meta-material by using the mathematical model having generalized time dependency, the method is not limited thereto, but may obtain the target characteristic of the meta-material by using another mathematical model described in a more simplified form as long as the other mathematical model satisfies a time-harmonic condition.

Figure 3:
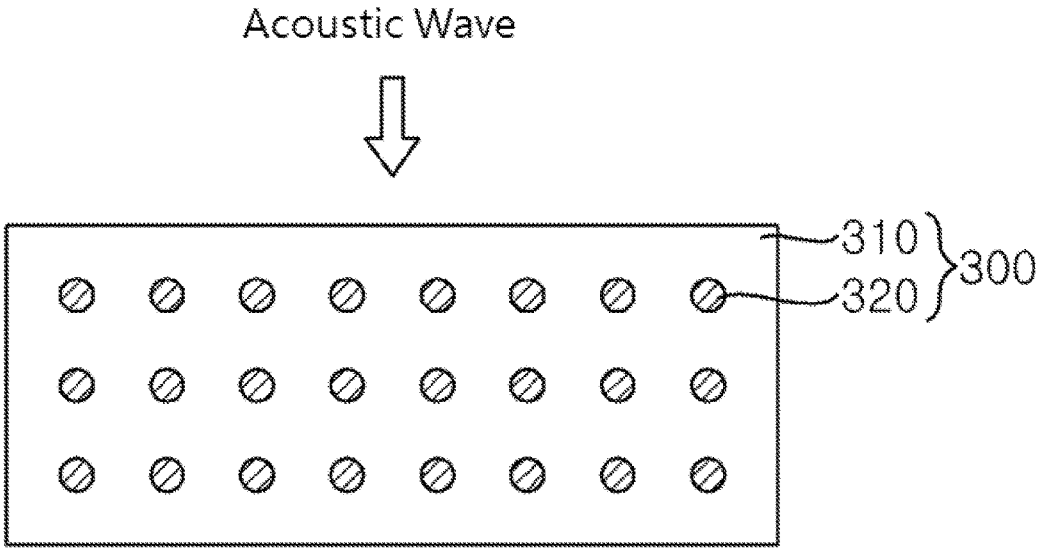
FIG. 3 shows the configuration of an acoustic wave cloaking device according to an embodiment of the present invention.
Figure 4:
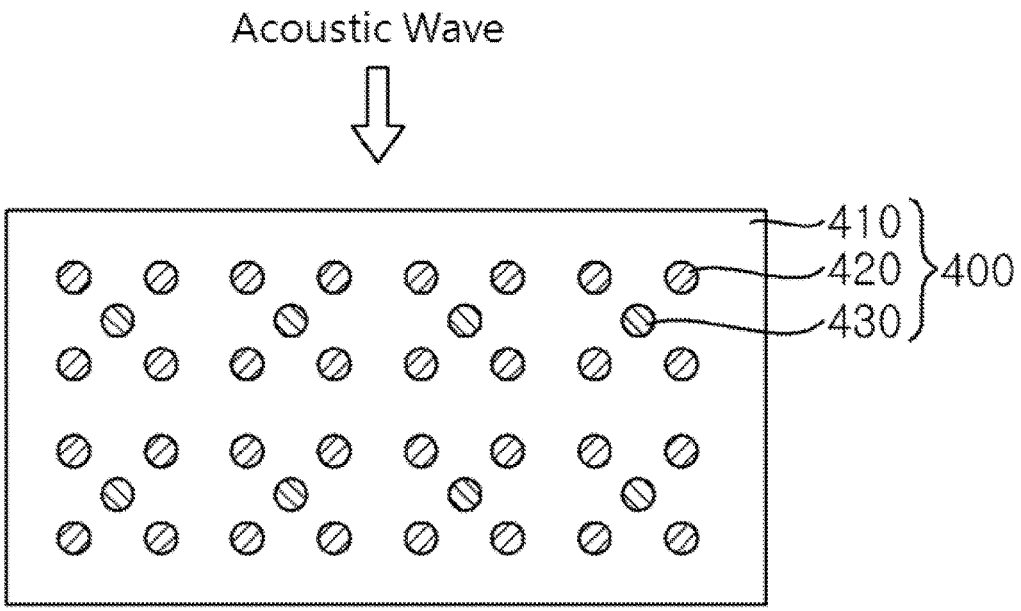
FIG. 4 shows the configuration of an acoustic wave cloaking device according to another embodiment of the present invention.
Figure 5:
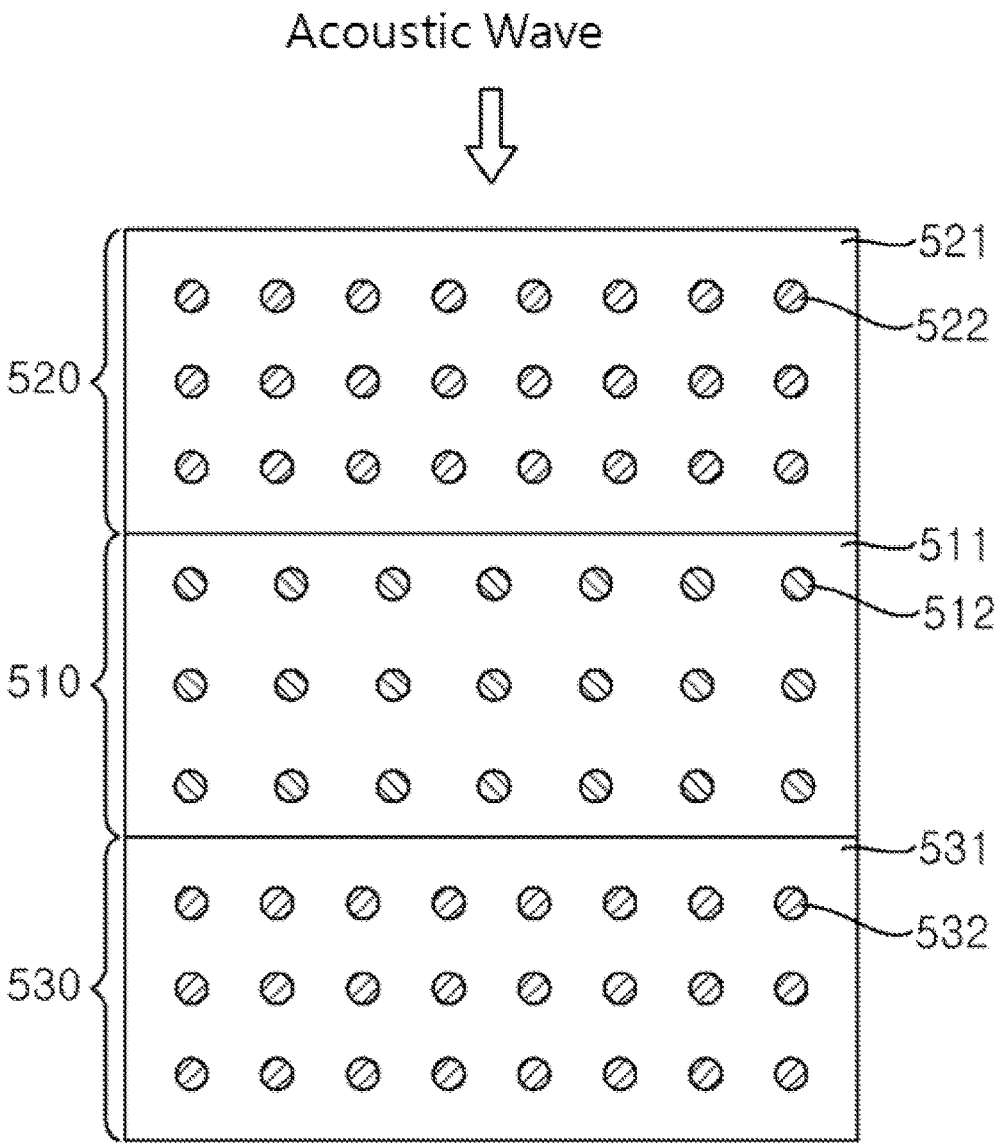
FIG. 5 shows the configuration of an acoustic wave cloaking device according to still another embodiment of the present invention.

FIGS. 3 to 5 show examples of meta-materials included in acoustic wave cloaking devices according to embodiments of the present invention.

Referring to FIGS. 3 to 5, a meta-material 300 shown in FIG. 3 is a lattice structure in which local resonance structures are periodically arranged, and includes scattering media 320 and a composite 310 containing the scattering media 320.

In this case, although the scattering media 320 have been illustrated as being arranged at regular intervals ranging, for example, from 0.5 to 50 cm, the arrangement of the scattering media 320 is not limited to this range, but the scattering media 320 may be arranged in one of various structures that have a target characteristic capable of blocking an acoustic wave in a specific band. The scattering media 320 may be configured to having the same media density. The composite 310 constituting a part of the meta-material 300 may include plastic resin, such as expanded polystyrene, epoxy, or the like.

For example, the meta-material 300 may be configured such that scattering media obtained by coating metal pipes having a radius of 5 mm with silicone rubber having a thickness ranging from 1 to 1.5 mm are arranged in the composite 310 in intervals ranging from 1.5 to 2.5 cm, and the total thickness of the meta-material 300 may range from 5 to 30 cm. It will be apparent that the total thickness of the meta-material 300 is not limited to the above-described numerical range but the meta-material 300 may have a thicknesses varying depending on an application field.

The meta-material used in the acoustic wave cloaking device may include at least two types of scattering media having different media densities. As in an example shown in FIG. 4, a meta-material 400 has a structure in which a first scattering media 420 having first spatial periodicity and a second scattering media 430 having second spatial periodicity are contained in a composite.

In this case, although the first spatial periodicity and the second spatial periodicity have been illustrated as being different in FIG. 4, the types of spatial periodicity are not limited thereto, but the two types of spatial periodicity may be the same. It will be apparent that depending on the situation, a single type of scattering media may be arranged to have different types of spatial periodicity. Such conditions may be determined based on the band of an acoustic wave to be blocked.

Furthermore, an acoustic wave cloaking device according to an embodiment of the present invention may include a plurality of meta-materials that are successively arranged. As in an example shown in FIG. 5, first meta-materials 520 and 530 in each of which first scattering media 522 or 532 are arranged in a first composite 521 or 531 to have first spatial periodicity may be disposed on opposite sides of a second meta-material 510 in which second scattering media 512 are arranged in a second composite 511 to have second spatial periodicity, thereby blocking an acoustic wave in a specific band.

In this case, the lattice constant of the first spatial periodicity and the lattice constant of the second spatial periodicity may be determined based on a specific band to be blocked. The lattice constant of the second spatial periodicity may be larger than the lattice constant of the first spatial periodicity. For example, the lattice constant of the first spatial periodicity may be 1.5 cm, and the lattice constant of the second spatial periodicity may range from 2 to 2.5 cm.

According to the present invention, by using scattering media arranged to have spatial periodicity so as to have a target characteristic obtained by applying a mathematical model for the propagation of an acoustic wave including generalized time dependency into a Maxwell's equations-based relativistic coordinate-space transformation method including generalized time dependency, a specific region can be blocked from an acoustic wave in a specific band, or an acoustic wave in a specific band generated by a specific object can be prevented from propagating to the outside.

Furthermore, according to the present invention, a target object or a specific region can be blocked from an acoustic wave, so that a noise source in a specific band can be isolated, an acoustic wave in a specific band can be fundamentally blocked in a desired area, and the present invention can be applied to the mitigation of noise between floors in an apartment building and a reduction of the noise level of a ship or a submarine in principle.

According to the present invention, the characteristic of the meta-material adapted to cloak an acoustic wave in a specific band can be obtained accordingly even when an acoustic wave cloaking target region has any geometrical shape that is applied to one or more of all coordinate systems including an elliptic coordinate system, a bipolar coordinate system, a Cartesian coordinate system, a cylindrical coordinate system, a spherical coordinate system, etc.

According to the present invention, the characteristic of the meta-material adapted to cloak a specific region from an acoustic wave in a specific band regardless of factors, such as the frequency and velocity of the acoustic wave can be obtained.

While the present invention has been described in conjunction with specific details, such as specific elements, and limited embodiments and diagrams, above, these are provided merely to help an overall understanding of the present invention. The present invention is not limited to these embodiments, and various modifications and variations can be made based on the foregoing description by those having ordinary knowledge in the art to which the present invention pertains.

Therefore, the technical spirit of the present invention should not be determined based only on the described embodiments, and not only the following claims but also all equivalents to the claims and equivalent modifications should be construed as falling within the scope of the spirit of the present invention.

What is claimed is:

1. A method of cloaking an acoustic wave, the method comprising:

obtaining a target characteristic of a meta-material based on a correlation between an acoustic propagation mathematical model predetermined for propagation of an acoustic wave and an electromagnetic wave mathematical model predetermined for an electromagnetic wave;

arranging scattering media, having a predetermined media density, to have spatial periodicity so that the obtained target characteristic is achieved; and blocking a target region including a target object from an acoustic wave by disposing the meta-material including the scattering media arranged to have spatial periodicity, to surround the target region, wherein the acoustic propagation mathematical model and the electromagnetic wave mathematical model includes a time variable for time dependency in a 4D coordinate system, wherein the target characteristic of the meta-material is obtained based on a space-time meta-material analysis based on the General Theory of the Relativity, wherein an empty space of a physical space corresponding to the target region to be hidden with the target object is transformed into a virtual space that has a point the empty space of the physical space is transformed thereto, so that the empty space of the physical space is hidden from external acoustic waves, and wherein the transformation of the physical space into the virtual space is obtained using covariant Maxwell's equations based on the General Theory of Relativity, and using a coordinate transformation equation according to a spatial topology of the target region and the meta-material.

2. The method of claim 1, wherein the obtaining comprises:

obtaining a correspondence between acoustic propagation parameters of the acoustic propagation mathematical model and electromagnetic wave parameters of the electromagnetic wave mathematical model; and obtaining the target characteristic of the meta-material by using the obtained correspondence between the acoustic propagation parameters and the electromagnetic wave parameters.

3. The method of claim 1, wherein the arranging comprises arranging, based on a correlation between media density among acoustic propagation parameters of the acoustic propagation mathematical model and permittivity among electromagnetic wave parameters of the electromagnetic wave mathematical model, the scattering media to have spatial periodicity so that a structure corresponding to a photonic crystal structure is achieved.

4. The method of claim 1, wherein the arranging comprises arranging the scattering media in a local resonance structure that induces local resonance.

5. The method of claim 1, wherein the obtaining comprises transforming the acoustic propagation mathematical model into an acoustic wave cloaking mathematical model, corresponding to the electromagnetic wave mathematical model and including a time variable for time dependency, based on a correlation between the acoustic propagation mathematical model and the electromagnetic wave mathematical model, and obtaining the target characteristic of the meta-material by using the obtained the acoustic wave cloaking mathematical model.

6. The method of claim 1, wherein the arranging comprises arranging the scattering media having an identical media density to have at least two different types of spatial periodicity.

7. The method of claim 1, wherein the arranging comprises arranging at least two different types of scattering media having different media densities to have identical spatial periodicity or different types of spatial periodicity.

8. The method of claim 1, wherein the blocking comprises blocking the region from the acoustic wave by stacking a first meta-material, including first scattering media arranged to have first spatial periodicity, and a second meta-material, including second scattering media arranged to have second spatial periodicity, to surround the region.

9. A device for cloaking an acoustic wave by using a meta-material, wherein the meta-material:

has a target characteristic obtained based on a correlation between an acoustic propagation mathematical model predetermined for propagation of an acoustic wave and an electromagnetic wave mathematical model predetermined for an electromagnetic wave;

comprises scattering media having a predetermined media density and arranged to have spatial periodicity so that the obtained target characteristic is achieved; and is disposed to surround a target region including a target object to be blocked from an acoustic wave, wherein the acoustic propagation mathematical model and the electromagnetic wave mathematical model includes a time variable for time dependency in a 4D coordinate system, wherein the target characteristic of the meta-material is obtained based on a space-time meta-material analysis based on the General Theory of the Relativity, wherein an empty space of a physical space corresponding to the target region to be hidden with the target object is transformed into a virtual space that has a point the empty space of the physical space is transformed thereto, so that the empty space of the physical space is hidden from external acoustic waves, and wherein the transformation of the physical space into the virtual space is obtained using covariant Maxwell's equations based on the General Theory of Relativity, and using a coordinate transformation equation according to a spatial topology of the target region and the meta-material.

10. The device of claim 9, wherein the meta-material has the target characteristic obtained using a correspondence between acoustic propagation parameters of the acoustic propagation mathematical model and electromagnetic wave parameters of the electromagnetic wave mathematical model obtained based on the correlation between the acoustic propagation mathematical model and the electromagnetic wave mathematical model.

11. The device of claim 9, wherein the scattering media are arranged to have a structure, corresponding to a photonic crystal structure, based on a correlation between media density among acoustic propagation parameters of the acoustic propagation mathematical model and permittivity among electromagnetic wave parameters of the electromagnetic wave mathematical model.

12. The device of claim 9, wherein the scattering media are arranged in a local resonance structure that induces local resonance.

13. The device of claim 9, wherein the scattering media have the target characteristic obtained using an acoustic wave cloaking mathematical model, including a time variable for time dependency, transformed from the acoustic propagation mathematical model based on a correlation between the acoustic propagation mathematical model and the electromagnetic wave mathematical model.

14. The device of claim 9, wherein the scattering media are arranged to have at least two different types of spatial periodicity.

15. The device of claim 9, wherein the scattering media comprise at least two different types of scattering media having different media densities and identical spatial periodicity or different types of spatial periodicity.

16. The device of claim 9, wherein the scattering media is formed by stacking a first meta-material, including first scattering media arranged to have first spatial periodicity, and a second meta-material, including second scattering media arranged to have second spatial periodicity.

* * * * *